US012808132B2

(12) United States Patent
Godelmann

(10) Patent No.: US 12,808,132 B2
(45) Date of Patent: Nov. 24, 2026

(54) MULTI-LAYER CONCRETE BLOCK FOR A PAVING, AS WELL AS PAVING AND METHOD FOR PRODUCING A CONCRETE BLOCK

(71) Applicant: Godelmann GmbH & Co. KG, Fensterbach (DE)

(72) Inventor: Bernhard Godelmann, Kummersbruck (DE)

(73) Assignee: Godelmann GmbH & Co. KG, Fensterbach (DE)

( * ) Notice: Subject to any disclaimer, the term of this patent is extended or adjusted under 35 U.S.C. 154(b) by 129 days.

(21) Appl. No.: 18/848,583

(22) PCT Filed: Mar. 1, 2023

(86) PCT No.: PCT/EP2023/055084
§ 371 (c)(1),
(2) Date: Sep. 19, 2024

(87) PCT Pub. No.: WO2023/180023
PCT Pub. Date: Sep. 28, 2023

(65) Prior Publication Data

US 2025/0230614 A1 Jul. 17, 2025

(30) Foreign Application Priority Data

Mar. 21, 2022 (DE) ..... 102022106481.6

(51) Int. Cl.
*E01C 5/06* (2006.01)
*E01C 9/00* (2006.01)
*E01C 11/22* (2006.01)

(52) U.S. Cl.
CPC ..... *E01C 5/065* (2013.01); *E01C 9/004* (2013.01); *E01C 11/225* (2013.01); *E01C 2201/20* (2013.01)

(58) Field of Classification Search
CPC ..... E01C 5/065; E01C 9/004; E01C 11/225; E01C 5/08
See application file for complete search history.

(56) References Cited

U.S. PATENT DOCUMENTS 1,412,504 A * 4/1922 Byrne ..... E01C 5/00 238/9
4,513,040 A * 4/1985 Lankard ..... E04F 15/08 106/644

(Continued)

FOREIGN PATENT DOCUMENTS

DE 102012100616 B4 7/2013
DE 202016000911 U1 6/2016

(Continued)

*Primary Examiner* — Patrick J Maestri
(74) *Attorney, Agent, or Firm* — WELSH FLAXMAN & GITLER LLC

(57) ABSTRACT

The invention relates to a concrete block in the form of a planar element that can be laid in combination in order to create a paving. The concrete block has at least one multi-layer concrete block body having at least one concrete-block lower face suitable for being laid on a foundation layer of an underlying surface, and a concrete-block upper face opposite thereto. The multi-layer concrete block body has at least one first concrete-block layer disposed on the concrete-block upper face and in the form of a face concrete layer, at least one second concrete-block layer in the form of a core concrete layer, as well as a third concrete-block layer. The second concrete-block layers is disposed between the first and the third concrete-block layer. The third concrete-block layer has an increased tensile strength.

17 Claims, 6 Drawing Sheets

(56) References Cited

U.S. PATENT DOCUMENTS

| | | | | |
|---|---|---|---|---|
| 2008/0190059 | A1* | 8/2008 | Hobbs | E01C 9/001<br>52/302.1 |
| 2011/0085856 | A1* | 4/2011 | Ma | E01C 11/225<br>404/39 |

FOREIGN PATENT DOCUMENTS

| | | | | | |
|---|---|---|---|---|---|
| DE | 202017105303 | U1 | | 10/2017 | |
| DE | 102020108785 | A1 | | 9/2021 | |
| DE | 102020122516 | A1 | | 3/2022 | |
| EP | 1589149 | B1 | | 10/2005 | |
| EP | 3153625 | A1 | | 4/2017 | |
| GB | 2189819 | A | * | 11/1987 | E01C 5/08 |
| KR | 101673838 | B1 | | 11/2016 | |
| KR | 102252941 | B1 | | 5/2021 | |
| NO | 20180329 | A1 | | 9/2018 | |
| WO | 2017115908 | A1 | | 7/2017 | |

* cited by examiner

MULTI-LAYER CONCRETE BLOCK FOR A PAVING, AS WELL AS PAVING AND METHOD FOR PRODUCING A CONCRETE BLOCK

BACKGROUND OF THE INVENTION

The invention relates to a multi-layer concrete block for a surface covering laid in bond and to a surface covering made of such multi-layer concrete blocks. Furthermore, the invention relates to a method for producing a concrete block of the said type.

Particularly in urban areas, large areas of the surface are designed as walkable or drivable traffic areas such as roads, paths, squares or parking lots and are covered with a surface covering. The surface covering is often produced by laying individual blocks in bond, particularly shaped concrete blocks. For example, such surface covering is produced via paving, wherein paving stones or corresponding concrete shaped blocks are laid in bond on a foundation layer of the underlying surface. As a rule, joints remain between adjacent concrete blocks or shaped blocks, particularly concrete paving blocks, which are filled with suitable, usually sand-like or grit-like joint materials. Such surface coverings, which are formed in the form of pavements, are sufficiently known from prior art.

It is also known to use multi-layer concrete blocks or concrete paving stones for creating such a surface covering. These multi-layer concrete blocks usually comprise at least one core layer and one face layer, wherein the core layer is usually made of a core concrete and forms a core of the concrete block, and wherein the face layer is usually made of a face concrete and forms the walkable or drivable concrete-block upper face, namely its visible surface.

It is also known that the multi-layer concrete blocks of the type mentioned, due to their structure and the nature of the individual layers, in particular, also due to the nature of the concrete used for producing the individual layers are designed in such a way that they comprise a certain or desired water permeability or water penetrability and/or also a certain or desired water storage capacity.

For example, DE 10 2012 100 616 B4 discloses a surface covering of two-layer molded bricks, which comprise a water-absorbing, water-permeable layer below an essentially impermeable layer on the surface so that the incident rainwater can drain downwards both through the joints as well as over the water-permeable layer of the molded blocks, i.e., via a seepage path through the concrete blocks themselves.

Where applicable, rainwater can also be stored, which can counteract a so-called urban "heat island effect" by increasing water evaporation, as evaporative cooling occurs when water evaporates. Such a water-storing concrete block is known, for example, from EP 3 153 625 A1.

Furthermore, it is known from prior art to use so-called grass paving stones in various embodiment variants, for example, as grass grating blocks or grass bar slabs for creating pavings with greenery. Such grass paving blocks usually comprise a grid-like or honeycomb-like base structure of longitudinal and transverse bars, wherein free spaces are created between these longitudinal or transverse bars, which form seepage openings through which rainwater can penetrate into the soil under the grass paving block. This makes them particularly suitable for producing water-permeable paving surfaces, which are desired for ecological reasons, by means of which a complete or largely complete sealing of the fastening surface can be avoided. In particular, such pavings may also be at least partially covered with greenery or partially covered with vegetation due to plant growth in the seepage openings.

Also and particularly with regard to grass paving blocks, it is desirable that the water permeability or water absorption and water storage by the grass paving blocks is such that a sufficient and optimal water supply is guaranteed for the plant growth in the seepage openings, if necessary also to survive longer dry periods. For example, EP 1 589 149 B1 describes a grass grating block with a two-layer structure, wherein the layers differ in their porosity so that water storage is possible by means of the laid grass grating blocks.

However, one problem with all the above-mentioned concrete blocks with water-absorbing, i.e., porous layers is the associated loss of stability of the concrete blocks, as such porous layers in the block structure usually reduce both the compressive as well as tensile stability of the concrete block. However, this reduced stability has a detrimental effect, particularly for drivable surface coverings that are also passed over by vehicles with high wheel loads. Such instabilities also often lead to breaks or cracks in the blocks during the processing of the concrete blocks, namely when laying and fastening the pavings so that a high level of rejects must be accepted in an unfavorable manner.

Therefore, there is still a need for multi-layer concrete blocks, the stability of which is improved.

SUMMARY OF THE INVENTION

The object of the present invention is therefore to provide a concrete block which overcomes the disadvantages of prior art and which, in particular, has increased stability. According to the invention, this object is solved by means of the device according to independent Claim 1. Furthermore, to solve the problem, a surface covering consisting of the said concrete blocks according to Claim 16 and a method for producing such concrete blocks according to Claim 17 is proposed. Other favorable aspects, details and embodiments of the invention result from the dependent claims, the description and the drawings.

The present invention provides a concrete block, in particular, in the form of a planar element that can be laid in bond in order to create a surface covering. The concrete block comprises at least a multi-layered concrete block body with at least one concrete-block lower face suitable for being laid on a foundation layer of an underlying surface and a concrete-block upper face opposite thereto. The multi-layer concrete block body comprises at least a first concrete-block layer disposed on the concrete-block upper face and formed as a face concrete layer, as well as at least a second concrete-block layer formed as a core concrete layer, wherein the multi-layer concrete block body also comprises at least a third concrete-block layer. The second concrete-block layer, which is formed as a core concrete layer, is disposed between the first and third concrete-block layers. In accordance with a particular aspect of the invention, the third concrete-block layer is designed as a high-strength concrete base layer with increased tensile strength, wherein the increased tensile strength of the third concrete-block layer is increased in comparison with the tensile strength of the second concrete-block layer, specifically preferably by at least 10%.

The present concrete block is therefore constructed in at least three layers. The third concrete-block layer provided for the present concrete block, which according to the invention is designed as a high-strength concrete base layer and comprises an increased tensile strength in comparison with the other concrete-block layers, in particular, in comparison with the core concrete layer, results in the special advantage that the concrete block is extremely stable, in particular, being dimensionally stable, fracture-proof and highly resistant to mechanical stresses, for example, due to tensile and bending forces.

Due to the high-strength concrete base layer provided according to the invention, an extremely high stability of the concrete block is ensured and guaranteed, regardless of the embodiment and dimensioning of the other at least two concrete-block layers. The present concrete block according to the invention can therefore be manufactured with a significantly lower height or thickness in comparison with conventional concrete blocks so that this results in particularly favorable versatile savings opportunities, ranging from material savings in production to space savings in transport and storage, which, in turn, result in cost savings, respectively.

Also, the high-strength concrete base layer according to the invention allows the concrete block to be manufactured in an application-related manner with a core concrete layer which comprises only a low structural density and, for example, is so coarse or porous or open-pored that it alone would not meet the desired and necessary stability requirements. However, the high-strength concrete base layer also supports and stabilizes a porous core concrete layer in such a way that the concrete block is sufficiently stable.

In accordance with a preferred embodiment of the concrete block according to the invention, the third concrete-block layer is made of a high-strength concrete which forms a dense and capillary-pore-poor structure, i.e, of a structurally dense high-strength concrete. The concrete base layer, which is made of high-strength concrete, is favorably resistant to tensile and compressive forces, in particular, to bending tensile forces and/or split tensile forces, wherein the high resistance of the concrete base layer directed against tensile and compressive forces is transferred to the entire concrete block. This effectively prevents the crack formation or rupture formation, both when laying the concrete blocks as well as when they are laid, for example, when high mechanical compressive and bending tensile forces are applied, which can occur when heavy vehicles drive on laid concrete blocks.

The tensile strength given in the unit $N/mm^2$ can be derived indirectly from the compressive strength, wherein the rough rule of thumb is applied that the tensile strength is about 10% of a measured compressive strength value. However, the tensile strength can also be determined by test methods such as testing or measuring the split tensile strength (e.g., DIN EN 12390-6) or bending tensile strength (DIN EN 12390-5).

The compressive strength, also given in the unit $N/mm^2$, can be measured on test specimens. For example, according to DIN EN 206-1/DIN 1045-2, the compressive strength must be verified for the determination of the characteristic strength and assignment of the strength class on test specimens at the age of 28 days.

Preferably, the third concrete-block layer comprises an increased bending tensile strength and/or an increased split tensile strength and thus comprises a specified minimum tensile strength, wherein, being particularly preferred, the third concrete-block layer also comprises an increased compressive strength. The concrete blocks laid in a surface covering are primarily subjected to bending tensile stress so that in the present case an increased bending tensile strength, in particular, a minimum bending tensile strength, is regarded as a decisive characteristic for the third concrete-block layer and the concrete block preferably comprises an increased bending tensile strength, in particular, a minimum bending tensile strength.

Due to the increased strengths and the adherence to a specified predetermined minimum tensile strength, the concrete block can be optimally designed depending on the area of application and, for example, specially adapted for use in walkable surface coverings or in surface coverings for heavy-goods traffic. The third concrete-block layer preferably comprises a tensile strength of at least 3 $N/mm^2$ or at least 4 $N/mm^2$ and, in particular, a tensile strength of more than 5 $N/mm^2$.

The third concrete-block layer is made of a high-strength concrete, particularly a high-strength concrete with a compressive strength of at least 50 $N/mm^2$. In the sense of the present invention, the term "high-strength concrete" can also be described as "high-performance concrete", which is characterized not only by high compressive strength and high resistance to mechanical stresses but also by a high durability. High-strength concrete is a special concrete composition that meets high processing and usage requirements, in particular, comprises a high resistance to mechanical, physical or chemical influences. The grading or classification of concrete compositions defined as "high-strength concrete" is carried out, for example, by means of a set of rules or standards familiar to the person skilled in the art.

The third concrete-block layer of the present concrete block is preferably made of a high-strength concrete whose concrete structure is optimized, in particular, by optimally matching aggregate and cement block properties, wherein, for example, the cement content of the high-strength concrete for producing the third concrete-block layer of the present concrete block is greater than about 350 $kg/m^3$ or 360 $kg/m^3$ or 370 $kg/m^3$ and, in particular, lies in a range between 380 $kg/m^3$ and 450 $kg/m^3$. Preferably, the cement content of the high-strength concrete for producing the third concrete-block layer is around 390 $kg/m^3$ or 400 $kg/m^3$ or 420 $kg/m^3$, For example, furthermore, the high-strength concrete for producing the third concrete-block layer can also contain additives, such as stone powder, carbon dust or also so-called silica dust, particularly microsilica or nanosilica, which further increases the tightness of the structure. For example, the addition of liquefier or superplasticizer to the composition for the high-strength concrete can also facilitate the processability during the formation of the third concrete-block layers.

Being particularly preferred, the high-strength concrete for producing the third concrete-block layer is assigned to a specified strength class, but can be, for example, a high-strength normal concrete or also a high-strength lightweight concrete. The strength class of the high-strength concrete is preferably selected from the following strength classes for normal concrete: C55/67 or C60/75 or C70/85 or C80/95 or C90/105 or C100/115 or from the following strength classes for lightweight concrete: LC55/67 or LC60/66 or LC70/77 or LC80/88 is selected.

The term "strength class" is used here as a synonym for the term "concrete compressive strength classes", which is also common in professional circles. The strength classes (e.g., according to DIN EN 1992-1-1) refer to the characteristic cylinder compressive strengths ($f_{ck}$), which are determined on separately manufactured concrete test specimens after defined storage at the age of 28 days. The standards classify high-strength concrete as concretes with a cylinder compressive strength of more than 50 $N/mm^2$ up to and including 100 $N/mm^2$ (C100/115).

According to the invention, the increased tensile strength of the third concrete-block layer is increased in comparison with the tensile strength of the second concrete-block layer. In particular, the third concrete-block layer comprises a higher tensile strength relative to the second concrete-block layer. A ratio of tensile strengths, namely the ratio of the increased tensile strength of the third concrete-block layer to the tensile strength of the second concrete-block layer (determined by the fracture: "value of the increased tensile strength of the third concrete-block layer"/"value of the tensile strength of the second concrete-block layer") is greater than 1.

Being particularly preferred, thee increased tensile strength of the third concrete-block layer is at least 15% higher than the tensile strength of the second concrete-block layer. Furthermore, the increased tensile strength of the third concrete-block layer is at least 20% higher than the tensile strength of the second concrete-block layer, being particularly preferred, at least 22%, at least 25% or at least 27% higher than the tensile strength of the second concrete-block layer and, in particular, preferably at least 30% or at least 35% higher than the tensile strength of the second concrete-block layer. The ratio of the increased tensile strength of the third concrete-block layer to the tensile strength of the second concrete-block layer is therefore preferably a value of at least 1.1 or at least 1.2 or at least 1.3.

In accordance with a particularly preferred embodiment variant of the concrete block according to the invention, the third concrete-block layer is made of a reinforced concrete or reinforced with at least one embedded reinforcing material. Reinforcement or strengthening with metallic or non-metallic reinforcement or reinforcing materials further effectively increases the tensile strength of the third concrete-block layers.

The reinforcement or strengthening material can be a fiber-like material embedded in the concrete, such as natural or synthetic fibers for example, also including textile fibers or glass fibers, fiber-like wire elements, such as steel wire fibers or steel fibers for example. The third concrete-block layer is therefore preferably made of fiber-reinforced concrete, in particular, steel-fiber concrete. Due to the good and easy handling of such fiber-reinforced concrete, the third concrete-block layer can be produced in a particularly favorable way in a simple and precisely defined way.

The third concrete-block layer preferably comprises a layer thickness in a range of 14 mm to 20 mm, preferably in a range of 16 mm to 18 mm, and can be particularly preferred in a layer thickness of around 15 mm, or 17 mm or 19 mm. With a layer thickness in the specified area, the third concrete-block layer, which is formed as a concrete base layer, is optimally adapted to give the concrete block the necessary stability simultaneously with the lowest possible overall height, specifically preferably independently of the other layer structure of the concrete block.

The second concrete-block layer, which is formed as a core concrete layer, is made of a non-fines porous core concrete and, in particular, forms a porous layer with an increased porosity, wherein the second concrete-block layer is preferably permeable to water and/or designed to absorb and store water. In this way, the concrete block makes a favorable contribution in that creating a surface covering consisting of a plurality of such concrete blocks does not lead to complete surface sealing, but that the seepage of rainwater is improved. It can also counteract a so-called urban "heat island effect" by allowing the rainwater which is stored in the porous layer to evaporate again when thermal or heat impacts on the surface covering, causing evaporative cooling.

For example, the second concrete-block layer, which is formed as a core concrete layer, comprises a core-concrete-layer thickness that is greater than the layer thickness of the third concrete-block layer. In preferred embodiments, the core-concrete-layer thickness is about 1.5 to 10 times, preferably 2 to 8 times, particularly preferably 3 to 6 times and, in particular, preferably 4 to 5 times the layer thickness of the third concrete-block layer. For example, the core-concrete-layer thickness is about 2.5 or 3.5 times, or 4.5 times or 5.5 times the layer thickness of the third concrete-block layer.

In accordance with a particularly preferred embodiment variant of the invention, the concrete block body is designed in the form of a grass paving block, namely in the form of a grating block or a grating slab or bar slab, in particular, in the form of a grass grating or grass bar slab. The concrete block body, which is designed as a grating or bar slab, preferably comprises at least two transverse bars and at least two longitudinal bars connecting the transverse bars. The transverse and longitudinal bars are disposed and spaced in such a way that at least one continuous seepage opening stretching from the concrete-block upper face to the concrete-block lower face is formed between the transverse and longitudinal bars. It is to be understood that in a particularly preferred way, more than two transverse and two longitudinal bars each can be provided in the concrete block body. For example, the concrete block body comprises at least three or at least four transverse bars and at least three or at least four longitudinal bars.

The third concrete-block layer, which is formed as a high-strength concrete base layer, is particularly favorable in the case of grass paving blocks, namely grating slabs or blocks or bar slabs or blocks, since such lattice-like concrete blocks are broken due to the seepage openings formed between the longitudinal and transverse bars and therefore the stability of these concrete blocks is additionally reduced by the openings. Due to the three-layer structure with the high-strength concrete base layer as the third layer, the stability of the existing grass paving block is significantly increased. The risk of breakage during transport and laying work, and thus the number of rejects, can be favorably reduced to a minimum. This not only results in cost savings, but also has a beneficial effect on sustainability through lower resource and energy consumption.

In accordance with a particularly preferred embodiment, the longitudinal bars of the grass paving block comprise a longitudinal-bar surface and the transverse bars comprise a transverse-bar surface. In this case, a bar height of the longitudinal bars is preferably lower than a bar height of the transverse bars so that the longitudinal-bar surface is set back in a vertical direction with relation to the transverse-bar surface. The transverse-bar surface essentially runs at a lower height in a lower horizontal plane and the longitudinal-bar surface runs at a higher height in an upper horizontal plane. Here, the upper horizontal level also forms the upper surface of the concrete-block upper face simultaneously.

Due to the lower height of the longitudinal bars, they are relatively thin and therefore particularly sensitive to tensile forces, particularly bending tensile forces. In the grass paving block, the longitudinal bars, which are thinner than the transverse bars, thus form areas susceptible to rupture. The high-strength concrete base layer has a stabilizing effect, in particular, on these thin areas of the lawn paving block.

The present invention further relates to a surface covering consisting of a plurality of concrete blocks laid in bond as described above, wherein the concrete blocks are laid on a suitable and intended or prepared foundation layer, preferably in such a way that defined joints are formed between adjacent concrete blocks.

The present invention also relates to a method or producing a concrete block described above. With that the method, after a formwork has been provided, at least a high-strength concrete is introduced into the formwork in at least a first step to produce a third concrete-block layer formed as a high-strength concrete base layer. In at least a second step, a non-fines porous core concrete is also introduced into the formwork to produce a second concrete-block layer formed as a core concrete layer, and in at least a third step, a face concrete is introduced into the formwork to produce a first concrete-block layer formed as a face concrete layer. Ultimately, the concrete material is then compressed and cured.

Preferably, the high-strength concrete and/or the non-fines porous core concrete introduced into the formwork can be pre-compressed at one or two intermediate steps before the face concrete is introduced.

The high-strength concrete is favorably applied to the formwork as a thin layer using first means for distributing concrete. The non-fines porous core concrete is then favorably charged thickly onto the thin layer of high-strength concrete by second means for distributing concrete and finally the face concrete is favorably charged onto the core concrete layer as a thin layer by third means for distributing concrete.

BRIEF DESCRIPTION OF THE DRAWINGS

The invention will be explained in more detail in the following based on the exemplary embodiments in connection with the drawings. The figures show.

DETAILED DESCRIPTION OF THE INVENTION

Figure 1:
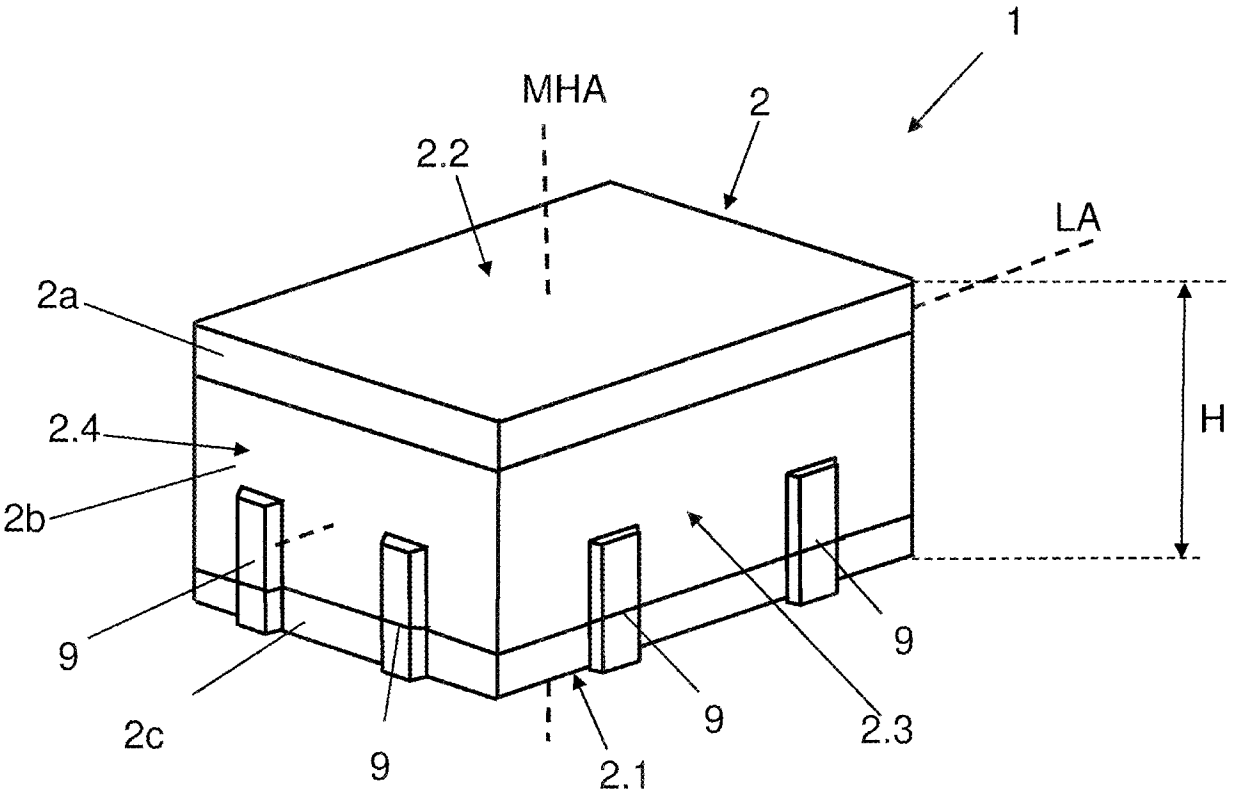
FIG. 1 greatly simplified and roughly schematically illustrated, a perspective view of an embodiment of a concrete block according to the invention.
Figure 2:
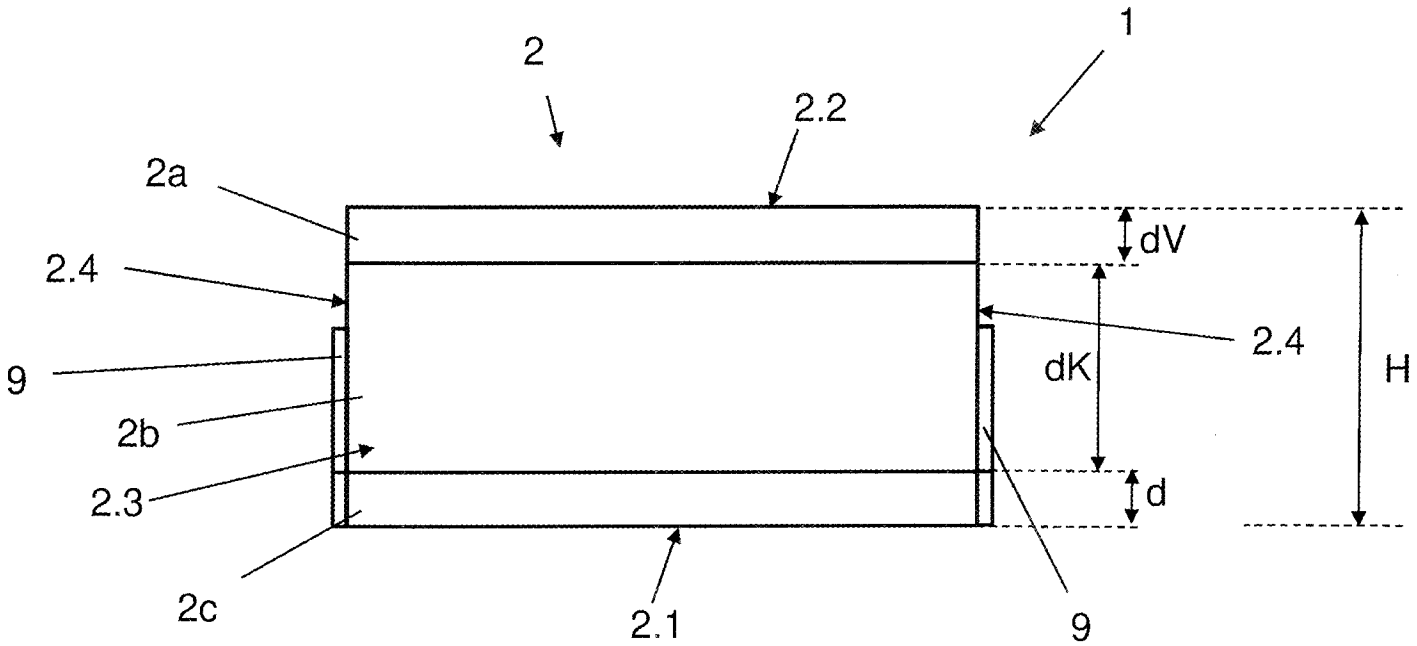
FIG. 2 a roughly schematic section through the concrete block of FIG. 1.

FIG. 1 shows a perspective view of an embodiment of the concrete block 1 according to the invention in a highly simplified schematic drawing, and FIG. 2 shows a schematic section along a section plane running parallel to a middle vertical axis MHA and parallel to a longitudinal axis LA of concrete block 1.

Figure 3:
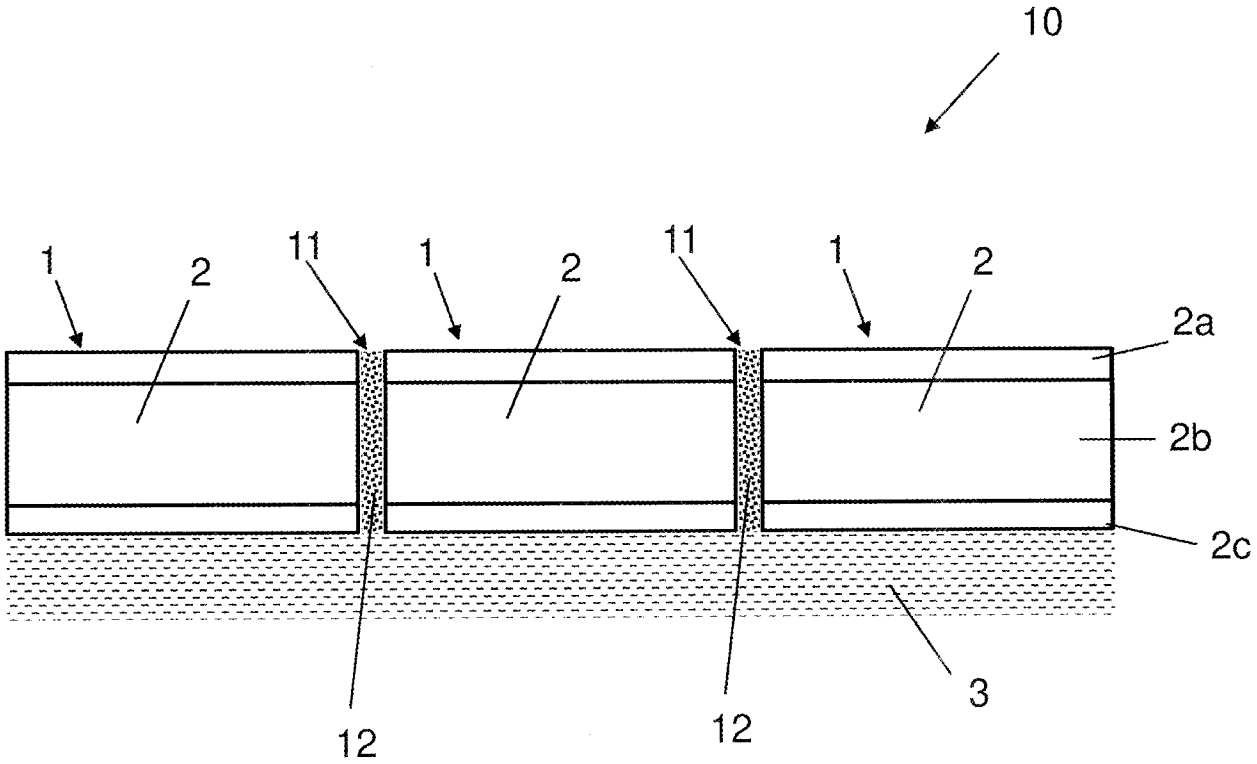
FIG. 3 a surface covering in a highly simplified sectional view.

Concrete block 1 is preferably designed in the form of a planar element that can be laid in bond to create a surface covering 10 (see FIG. 3). In the present understanding, concrete block or concrete slab are essentially structurally identical elements that can be used for creating a surface covering 10 in a manner that is known in itself. For example, the concrete block 1 can be a concrete paving block. Depending on the selected laying patterns, the concrete blocks 1 are laid in bond and flush with each other so that a preferably flat paving 10 is created.

The concrete block 1 comprises at least a multi-layered concrete block body 2 with at least one flat concrete-block lower face 2.1 and an essentially flat concrete-block upper face 2.2 opposite, which preferably forms the tread or drivable surface or also a traffic area. The precise embodiment of the lateral surface sections of concrete block 1 is not relevant for the invention, i.e., the precise cross-sectional shape of concrete block 1 can be chosen almost arbitrarily without thereby abandoning the idea of the invention.

In the present exemplary embodiment, the concrete block 1 is cuboid in shape and comprises two pairs of two concrete-block faces of the same surface and facing each other 2.3, 2.4. The concrete-block lower face 2.1 and the concrete-block upper face 2.2 run vertically or approximately perpendicular to the middle vertical axis MHA of the concrete block body 2 and concrete block 1 respectively. The concrete-block faces 2.4 extend essentially perpendicular to the longitudinal axis LA and the concrete-block faces 2.3 extend essentially parallel to the longitudinal axis LA.

The multi-layer concrete block body 2 comprises at least a first concrete-block layer 2*a*, which is formed as a face concrete layer and forms the concrete-block upper face 2.2, at least a second concrete-block layer 2*b* adjacent to the first concrete-block layer 2*a* in the direction of the middle vertical axis MHA and formed as a core concrete layer, and a third concrete-block layer 2*c* connected to the second concrete-block layer 2*b* in the direction of the middle vertical axis MHA, which forms the concrete-block lower face 2.1 and is intended to be supported on a foundation layer 3 of an underlying surface. The second concrete-block layer 2*b*, which is formed as a core concrete layer, is thus disposed between the first and third concrete-block layers 2*a*, 2*c*.

The third concrete-block layer 2*c* is designed as a high-strength concrete base layer and comprises an increased tensile strength, in particular, an increased bending tensile strength.

In the example shown in FIGS. 1 and 2, the third concrete-block layer 2*c* is made of a high-strength concrete, wherein the high-strength concrete of the third concrete-block layer 2*c* is a structurally dense concrete with a cement content in a range between about 350 kg/m3 and 450 kg/m3, preferably between 380 kg/m3 and 400 kg/m3. The high-strength concrete of the third concrete-block layer 2*c*, for example, comprises a compressive strength of at least 55 N/mm2 and a bending tensile strength of at least 5 N/mm2. The third concrete-block layer 2*c* is made in particular, of a high-strength concrete, as defined in accordance with the set of standards, wherein the concrete for producing the third concrete-block layer 2*c* is, for example, a high-strength concrete of compressive strength class C55/67.

The third concrete-block layer 2*c* of the concrete block 1 of the example shown comprises a layer thickness d, which lies in a range between about 16 mm and 18 mm. In the exemplary concrete block 1 shown in FIGS. 1 and 2, the first concrete-block layer 2*a*, which is formed as a face concrete layer, comprises a face-concrete-layer thickness dV, which can be in a range between 10 mm and 20 mm. The second concrete-block layer 2*b*, which is formed as a core concrete layer with its core-concrete-layer thickness dK, is the layer with the greatest layer thickness in the example concrete block 1 shown in FIGS. 1 and 2, i.e., the core concrete layer here occupies the largest proportion of the concrete block body 2, which comprises a total height H, which preferably corresponds to the sum of the layer thicknesses dV, dK, d of the first to third concrete-block layers 2*a*, 2*b*, 2*c*.

The second concrete-block layer 2*b*, which is formed as a core concrete layer, is made of a non-fines porous concrete and thus forms a water-permeable or water-absorbing layer in the concrete block body 2. The concrete composition of the non-fines porous second concrete-block layer 2*b* is such that the second concrete-block layer 2*b* is equipped with pores, in particular, in the desired or defined number of pores as well as the desired or defined average size of the pores. Rainwater that hits the concrete block 1 laid in a surface covering 10 in its state of use can be absorbed into the pores of the second concrete-block layer 2*b* or also run off through the pores. The second concrete-block layer 2*b* can also be used, in particular, for water storage.

For optimal absorption and storage of water, the core-concrete-layer thickness dK of the second concrete-block layer 2*b* is between 40% and 80% of the total height H of the concrete block body 2, preferably between 50% and 70% of the total height H of the concrete block body 2.

In the exemplary embodiment shown, concrete block 1 comprises so-called spacers or spacer lugs 9, which ensure uniform joints 11 (see FIG. 3) in approximately uniform width when laying concrete block 1 in bond and ensure a minimum width of joints 11.

FIG. 3 shows an example of a section through a surface covering 10 formed from the existing concrete blocks 1. The surface covering 10 comprises a plurality of multi-layer concrete blocks 1 laid in bond on a foundation layer 3 of an underlying surface. Joints 11 are formed between adjacent concrete blocks 1 of the surface covering 10, which are filled with a joint material 12 and form a seepage path for the drainage of rainwater from the surface of the surface covering 10 facing away from foundation layer 3. Foundation layer 3 is a conventional foundation layer that essentially consists of a mixture of materials with a grain size of 0.1 mm to 5 mm.

The production or manufacture of the present concrete block 1 can be carried out by means of industrial manufacturing methods, in which concrete blocks 1 are produced in a process-controlled manner, preferably in layers, i.e., a plurality of concrete blocks 1 simultaneously in one layer. First, as part of the manufacturing method, a well-known concrete formwork is provided for producing concrete blocks 1. After the formwork has been provided, at least one high-strength concrete is placed in the formwork in at least one first step to produce the third concrete-block layer 2*c*, which is designed as a high-strength concrete base layer. In at least a second step, a non-fines porous core concrete is also introduced into the formwork to produce the water-permeable second concrete-block layer 2*b*, which is formed as a core concrete layer, and in at least a third step, face concrete is introduced into the formwork to produce the first concrete-block layer 2*a*, which is formed as a face concrete layer. The concrete material is then compressed and cured.

Figure 5:
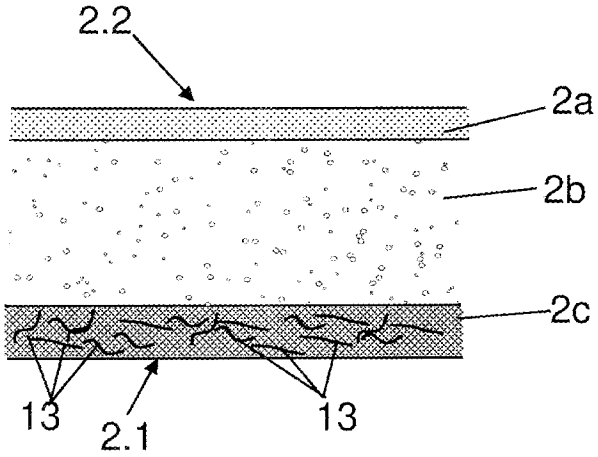
FIG. 5 a section of a further embodiment of the concrete block body in a schematic lateral view.
Figure 4:
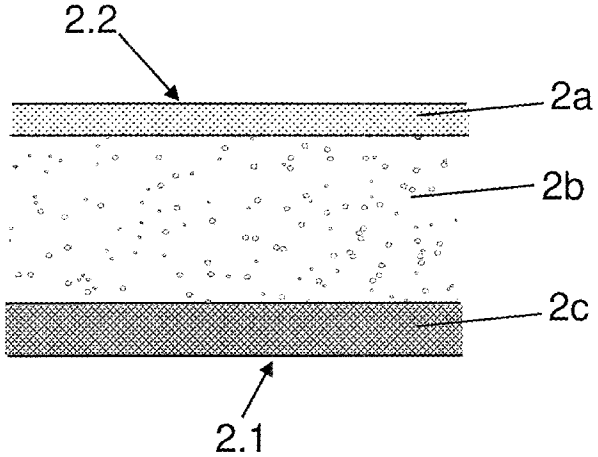
FIG. 4 a schematic view of a section of an embodiment of the concrete block body.

FIGS. 4 and 5 show a schematic sketch of the layer structure of the concrete block body 2 on the basis of a schematic section of the concrete block body 2 of a respective embodiment of the present concrete block 1. In the example of FIG. 4, the third concrete-block layer 2*c*, which is formed as a high-strength concrete base layer, is made of a structure-tight, high-strength concrete, as already described above. In the concrete block body 2 of the example of FIG. 5, the third concrete-block layer 2*c* is additionally reinforced or armored. Here, a armor or reinforcement material is embedded in the concrete of the third concrete-block layer 2*c* in order to additionally increase the tensile strength, particularly the bending tensile strength. In the example shown, a fiber reinforcement or fiber armor is provided for this purpose, wherein the fibers embedded in the concrete are 13 steel fibers or steel wire fibers, for example, and the third concrete-block layer is therefore a layer made of steel fiber concrete.

With reference to FIGS. 6 to 10, further, particularly preferred embodiments of the present concrete block 1 are described, namely variants of concrete block 1, which are designed as a grating block or as a bar slab, namely as a grass grating block 4 or a grass bar slab 5. The grass grating block 4 can also be synonymously referred to as the grass grating slab 4 and the grass bar slab 5 can also be synonymously referred to as the grass grating block 5.

The concrete block body 2 of the grass grating or grass bar slab 4, 5 comprises transverse bars 6*a*, 6*b* as well as the longitudinal bars 7*a*, 7*b* connecting the transverse bars 6*a*, 6*b*, wherein the transverse and longitudinal bars 6*a*, 6*b*, 7*a*, 7*b* are disposed and spaced in such a way that one or a plurality of seepage openings 8 is/are formed between the transverse and longitudinal bars 6*a*, 6*b*, 7*a*, 7*b*. Each seepage opening 8 extends continuously from the concrete-block upper face 2.2 to the concrete-block lower face 2.1 and forms an open cavity or free space on the upper and lower sides or a break in the concrete block body 2.

The grass grating or grass bar slabs 4, 5 can also be used for creating a surface covering laid in a familiar way in bond and are used, for example, particularly for surface coverings covered with vegetation or surface coverings covered with greenery or for the purpose of surface reinforcement in green areas. The seepage openings 8, which are open upwards towards the concrete-block upper face 2.2 and also downwards towards the concrete-block lower face 2.2, are filled with soil, sand or the like when laid and serve as a planting space in which the greenery plants, such as grass for example, can grow and can even directly reach the soil below with their root system.

Figure 6:
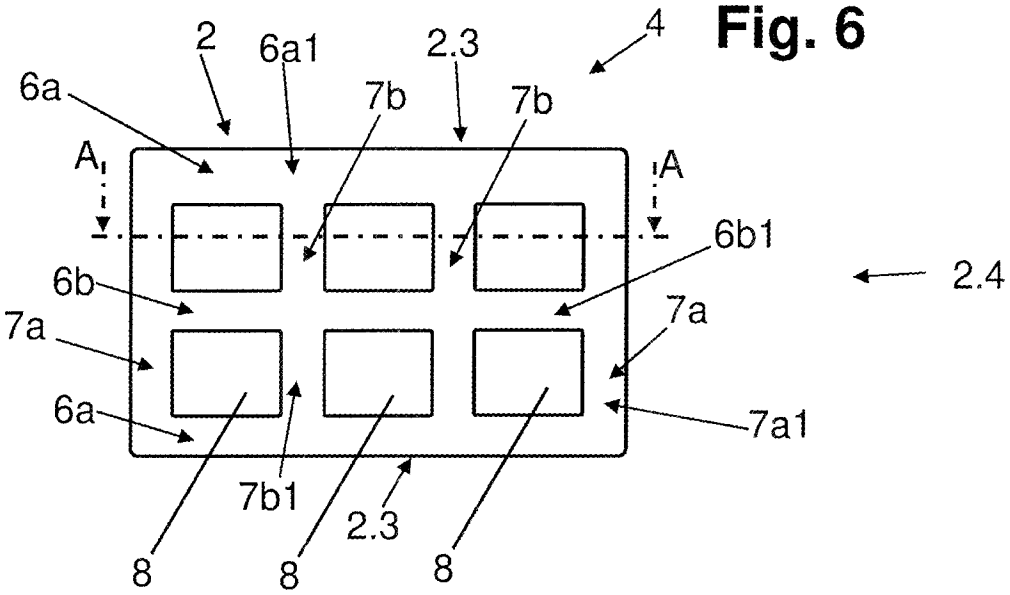
FIG. 6 greatly simplified and roughly schematically illustrated, a top view of the concrete-block upper face of an embodiment of a concrete block according to the invention.
Figure 7:
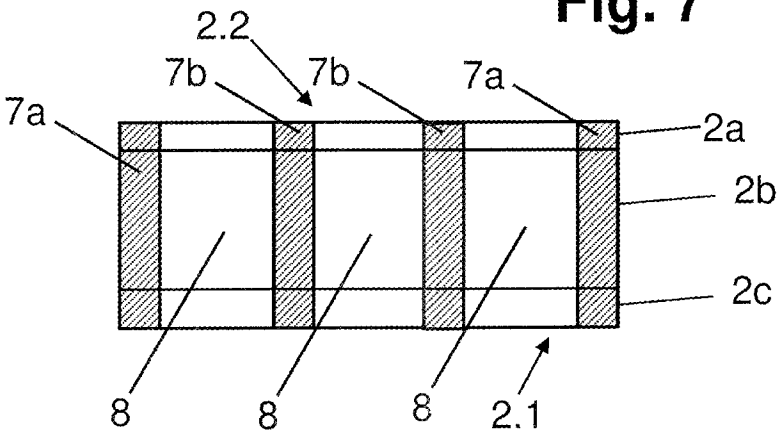
FIG. 7 a roughly schematic section through the concrete block of FIG. 6.

The concrete block body 2 of the grass grating block 4 shown in FIGS. 6 and 7, which is shown in FIG. 6 in a top view of the concrete-block upper face 2.2 and in FIG. 7 in a section along the line A-A, is essentially cuboid and comprises two outer transverse bars 6*a*, a middle transverse bar 6*b* as well as two outer longitudinal bars 7*a* and two middle longitudinal bars 7*b*. The transverse bars 6*a*, 6*b* run essentially parallel to each other and perpendicular to the longitudinal bars 7*a*, 7*b*, which in turn are disposed parallel to each other. The outer transverse and longitudinal bars 6*a*, 7*a* form the perimeter sides of the concrete block body 2, namely the concrete-block faces 2.3, 2.4 and are designed as a surrounding circumferential surface. It is to be understood that the number and arrangement of the transverse bars and longitudinal bars 6*a*, 7*a* is only exemplary and can of course deviate from the illustration of FIGS. 6 and 7 without thereby abandoning the idea of the invention.

The transverse and longitudinal bars 6*a*, 6*b*, 7*a*, 7*b* comprise the same height in the example shown in FIG. 4 so that the respective transverse-bar surfaces 6*a*1, 6*b*1 and respective longitudinal-bar surfaces 7a1, 7b1 are essentially taken up in a common plane and together form an upper, essentially flat surface of the concrete-block upper face 2.2.

The grass grating block 4 shown as an example comprises six seepage openings 8 and thus six continuous openings. As can be seen from the cross-sectional view of FIG. 7, both the transverse bars 6a, 6b and the longitudinal bars 7a, 7b are constructed in three layers and comprise the first concrete-block layer 2a, which is designed as a face concrete layer, the second concrete-block layer 2b, which is formed as a core concrete layer, and the third concrete-block layer 2c, which is designed as a high-strength concrete base layer.

Figure 8:
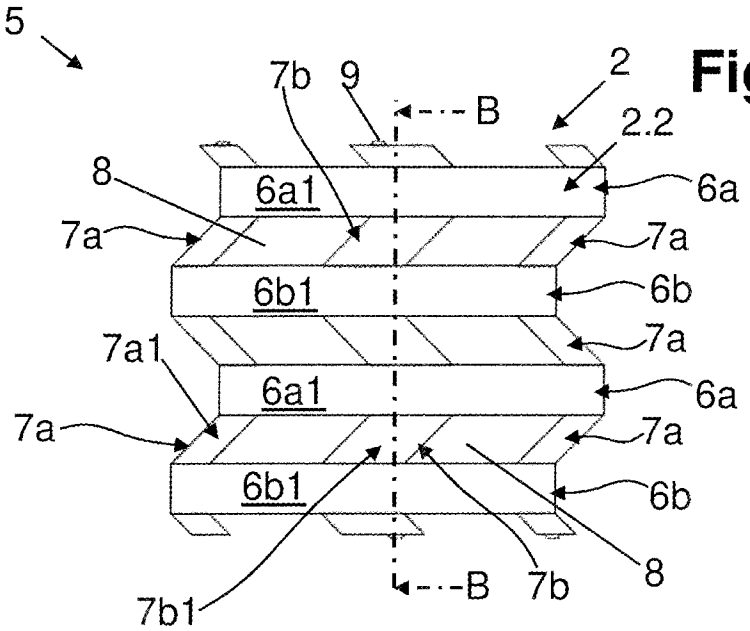
FIG. 8 greatly simplified and roughly schematically illustrated, a top view of the concrete-block upper face of an embodiment of a concrete block according to the invention.
Figure 10:
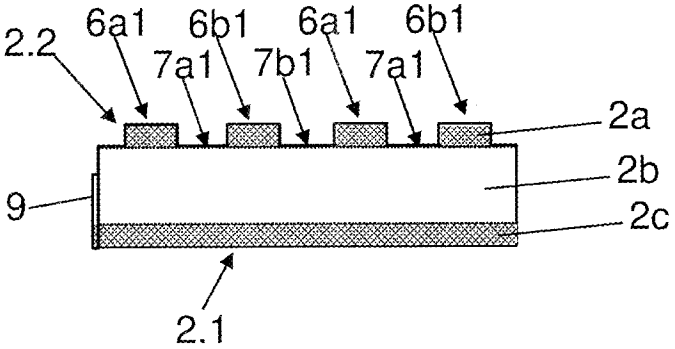
FIG. 10 a roughly schematic section through the concrete block of FIG. 7.
Figure 9:
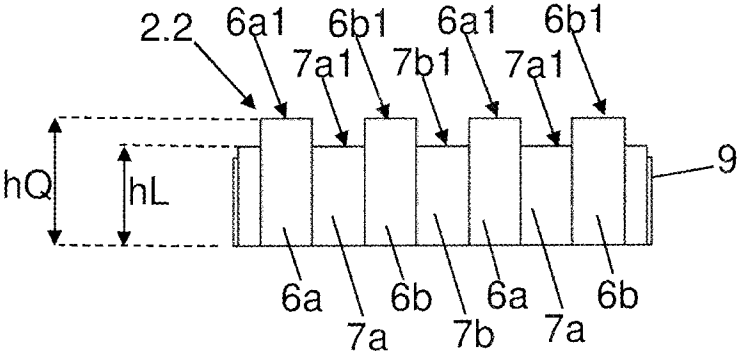
FIG. 9 a schematic lateral view of the concrete block of FIG. 7.

FIGS. 8 to 10 show an example of a preferred variant of the present grass bar slab 5, which is shown in FIG. 8 in a top view of the concrete-block upper face 2.2, in FIG. 9 in a lateral view and in FIG. 10 in a section along the line B-B indicated in FIG. 8.

The concrete block body 2 of the example shown comprises four transverse bars 6a, 6b and three longitudinal bars 7a, 7b, wherein the three longitudinal bars 7a, 7b are essentially zigzagging and connect the four straight transverse bars 6b, 6b, in such a way that neighboring transverse bars 6a, 6b are disposed offset in their length from each other. The transverse bars 6a, with their flush ends at a first edge of concrete block 2 (in FIG. 8, right), form an outer edge defining the outer perimeter, and analogously, the transverse bars 6b, with their flush ends on an opposite edge of concrete block 2 (in FIG. 8, left), form an opposite outer edge.

It is to be understood that both the shape of the longitudinal bars 7a, 7b and also the number and arrangement of the transverse and longitudinal bars 6a, 7a are merely exemplary and may of course deviate from the illustration of FIGS. 8 to 10 without thereby abandoning the idea of invention.

In the example of FIGS. 8 to 10, the transverse bars 6a, 6b comprise a bar height hQ and the longitudinal bars 7a, 7b comprise a bar height hL, wherein the bar height hL is less than the bar height hQ. With regard to an upper surface defined by the concrete-block upper face 2.2, the respective longitudinal-bar surfaces 7a1, 7b1 are thus set back vertically downwards in relation to the transverse-bar surfaces 6a1, 6b1. As can be seen from FIG. 10, the grass bar slab 5 is also designed in three layers and includes the first, second and third concrete-block layers 2a, 2b, 2c.

In the case of the grass bar slab 5 shown as an example, the longitudinal-bar surfaces 7a1, 7b1, which are set back downwards, are covered or filled with soil and/or sand in case of application, i.e., in the installed state so that essentially only the transverse-bar surfaces 6a1, 6b1 are visible to the outside. Plant growth or greening is thus possible not only in the area of the seepage openings 8, but also in the entire area between the transverse bars 6a, 6b, i.e., over the entire area between the transverse bars 6a, 6b, which is why in these special forms of application it is also possible, for example, to use the concrete block body 2 in the area of the longitudinal bars 7a, 7b to dispense with the first concrete-block layer 2a, which is designed as a face concrete layer, as shown by way of example in FIG. 10.

In the case of concrete blocks 1, which are designed as grass grating blocks or grass bar slabs 4, 5, the third concrete-block layer 2c, which is designed as a high-strength concrete base layer, has a particularly favorable effect, since the concrete block bodies 2 of these embodiments are generally less stable in comparison with solid blocks due to the existing seepage openings 8 formed by respective openings. However, the loss of stability resulting from the perforated structure can be more than compensated for with the high-strength concrete base layer so that this results in extremely stable, particularly break-resistant grass grating blocks or grass bar slabs 4, 5. Particularly in the case of these embodiments as grating blocks or bar slabs, the fact that the concrete block bodies 2 can be manufactured at a lower height due to the high-strength concrete base layer has a particularly favorable effect.

In combination with the third concrete-block layer 2c, i.e., with the high-strength concrete base layer, in the case of the present grass grating or grass bar slabs 4, 5, the second concrete-block layer 2b, which is pervious in terms of its density and porosity, can also be adapted in an ideal, optimal way in terms of its density and porosity for a particularly effective and good water conductivity or water storage capacity, without thereby having to accept the disadvantage of low stability and fracture resistance of the concrete block 1. The lawn lattice or lawn bar slabs 4, 5 are therefore particularly well adapted to their intended use and ensure an effective, effective water supply to the greenery or growing plants. The non-fines porous second concrete-block layer 2b can thus be specially adapted to store water and later, particularly in longer dry phases, gradually release it back to the plants so that concrete blocks 1 can also make a significant contribution to the supply of the plants to survive dry periods.

REFERENCE LIST

1 concrete block
2 concrete block body
2a first concrete-block layer
2b second concrete-block layer
2c third concrete-block layer
2.1 concrete-block lower face
2.2 concrete-block upper face
2.3, 2.4 concrete-block faces
3 foundation layer
4 grating slab
5 bar slab
6a, 6b transverse bars
6a1, 6b1 transverse-bar surface
7a, 7b longitudinal bars
7a1, 7b1 longitudinal-bar surface
8 seepage opening
9 spacer
10 surface covering
11 joints
12 joint material
13 fibers
d layer thickness of the third concrete-block layer
dK core-concrete-layer thickness
dV face-concrete-layer thickness
H total height of the concrete block
hL bar height of the longitudinal bars
hQ bar height of the transverse bars
MHA middle vertical axis
LA longitudinal axis

The invention claimed is:

1. A concrete block in the form of a planar element that can be laid in bond for creating a surface covering, comprising at least one multi-layer concrete block body with at least one concrete-block lower face suitable for being laid on a foundation layer of an underlying surface and a concrete-block upper face opposite thereto, wherein the multi-layer concrete block body comprises at least one first concrete-block layer disposed on the concrete-block upper face and designed as a face concrete layer, as well as at least one second concrete-block layer formed as a core concrete layer, wherein the multi-layer concrete block body also comprises a third concrete-block layer and wherein the at least one second concrete-block layer formed as a core concrete layer, is disposed between the at least one first concrete-block layer and the third concrete-block layer, wherein the third concrete-block layer is formed as a high-strength concrete base layer with increased tensile strength, wherein the increased tensile strength of the third concrete-block layer is increased in comparison with the tensile strength of the at least one second concrete-block layer by at least 10%, and wherein the at least one multi-layer concrete block body is formed in the form of a grating slab or bar slab in the form of a grass grating or grass bar slab.

2. The concrete block according to claim 1, wherein the third concrete-block layer is made of a structurally tight, high-strength concrete, wherein the high-strength concrete comprises a cement content of more than 380 kg/m$^3$.

3. The concrete block according to claim 1, wherein the third concrete-block layer comprises an increased bending tensile strength and/or an increased split tensile strength and the third concrete-block layer thus comprises a specified minimum tensile strength of at least 3 N/mm$^2$.

4. The concrete block according to claim 1, wherein the tensile strength of the third concrete-block layer is at least 15% higher than the tensile strength of the at least one second concrete-block layer.

5. The concrete block according to claim 1, wherein the third concrete-block layer is made of an armored concrete or of a concrete reinforced with at least one embedded reinforcing material.

6. The concrete block according to claim 5, wherein the third concrete-block layer is made of a fiber-reinforced concrete, of steel fiber concrete.

7. The concrete block according to claim 1, wherein the third concrete-block layer comprises a layer thickness in a range of 14 mm to 20 mm.

8. The concrete block according to claim 1, wherein the at least one second concrete-block layer formed as a core concrete layer, is made of a core concrete with a non-fines porous core concrete and forms a porous layer with an increased porosity.

9. The concrete block according to claim 8, wherein the at least one second concrete-block layer is permeable to water and/or designed to absorb and store water.

10. The concrete block according to claim 1, wherein the at least one second concrete-block layer formed as a core concrete layer comprises a core-concrete-layer thickness greater than a layer thickness of the third concrete-block layer.

11. The concrete block according to claim 1, wherein the at least one multi-layer concrete block body formed as a grating or bar slab comprises at least two transverse bars and at least two longitudinal bars connecting the at least two transverse bars, wherein the at least two transverse and at least two longitudinal bars are disposed and spaced from each other in such a way that at least one continuous seepage opening extending from the concrete-block upper face to the concrete-block lower face is formed between the at least two transverse and at least two longitudinal bars.

12. The concrete block according to claim 1, wherein the at least one multi-layer concrete block body comprises at least three transverse bars and at least three longitudinal bars.

13. The concrete block according to claim 1, wherein the at least two longitudinal bars comprise a longitudinal-bar surface and the at least two transverse bars comprise a transverse-bar surface, wherein a bar height (hL) of the at least two longitudinal bars is less than a bar height (hQ) of the at least two transverse bars so that the longitudinal-bar surface is set back with respect to the transverse-bar surface.

14. A surface covering comprising a plurality of multi-layer concrete blocks laid in bond on a foundation layer of an underlying surface according to claim 1, wherein each concrete block comprises at least a first, a second and a third concrete-block layer, wherein the third concrete-block layer is formed as a high-strength concrete base layer with increased tensile strength and wherein the increased tensile strength of the third concrete-block layer is increased in comparison with a tensile strength of the second concrete-block layer by at least 10%.

15. A concrete block according claim 1, wherein after a formwork has been provided, at least one high-strength concrete layer is introduced into the formwork in at least a first step to produce the third concrete-block layer as a high-strength concrete base layer, in which a core concrete layer is introduced into the formwork in at least a second step to produce the at least one second concrete-block layer as a core concrete layer formed by least one of the concrete block and in which a face concrete is introduced into the formwork in at least a third step to produce the at least one first concrete block layer formed by least one of the concrete-block layers as a face concrete layer, wherein the concrete material introduced is then compressed and cured.

16. The concrete block according to claim 15, wherein the high-strength concrete and/or core concrete introduced into the formwork is pre-compressed in one or two intermediate steps prior to the application of the face concrete.

17. The concrete block according to claim 15, wherein the high-strength concrete is introduced into the formwork as a thin layer using first means for distributing concrete, then the core concrete is charged thickly onto to the thin layer of high-strength concrete with second means for distributing concrete, and finally the face concrete is charged onto the core concrete layer as a thin layer with third means for distributing concrete.

* * * * *